US008550864B2

(12) United States Patent
Beachy Head

(10) Patent No.: US 8,550,864 B2
(45) Date of Patent: Oct. 8, 2013

(54) DRIVES FOR PROPULSION OF MARINE VESSELS

(76) Inventor: Michael Alan Beachy Head, Newlands (ZA)

( * ) Notice: Subject to any disclaimer, the term of this patent is extended or adjusted under 35 U.S.C. 154(b) by 223 days.

(21) Appl. No.: 13/166,535

(22) Filed: Jun. 22, 2011

(65) Prior Publication Data

US 2012/0329346 A1 Dec. 27, 2012

(51) Int. Cl.
*B63H 23/02* (2006.01)

(52) U.S. Cl.
USPC ..... 440/75; 440/53

(58) Field of Classification Search
USPC ..... 440/53, 58, 59, 75, 78
See application file for complete search history.

(56) References Cited

U.S. PATENT DOCUMENTS

| | | | | |
|---|---|---|---|---|
| 3,362,246 | A | 1/1968 | Bergstedt | |
| 3,589,204 | A | 6/1971 | Langley | |
| 3,826,219 | A * | 7/1974 | Nossiter | 440/75 |
| 6,902,451 | B1 | 6/2005 | Theisen | |
| 7,588,473 | B2 | 9/2009 | Beachy Head | |
| 7,794,295 | B2 | 9/2010 | Beachy Head | |

FOREIGN PATENT DOCUMENTS

| | | |
|---|---|---|
| GB | 2179903 | 3/1987 |
| SU | 1 108 042 | 8/1984 |
| WO | WO 2006/089316 | 8/2006 |

OTHER PUBLICATIONS

European Patent Office—International Searching Authority—Patent Cooperation Treaty—International Search Report mailed Mar. 7, 2012, Application No. PCT/IB2011/052547 filing date Jun. 10, 2011, 6 pages, NL Rijswijk.

* cited by examiner

*Primary Examiner* — Lars A Olson
(74) *Attorney, Agent, or Firm* — Haynes and Boone, LLP

(57) ABSTRACT

A marine propulsion system includes a gearbox housing that is attached to the stern of a vessel hull, a pivot casing that can pivot relative to the gearbox housing for trim/tilt and a lower unit that can pivot relative to the pivot casing to steer. The gearbox housing houses an input shaft, which is connected via a gear set to an intermediate shaft, which is connected via a bevel gear set to a transverse shaft, which extends into the pivot casing. Inside the pivot casing, a drive shaft is connected to the transverse shaft via a clutch assembly and the drive shaft extends from the pivot casing to the lower unit, where it drives a propeller shaft. The pivot casing pivots about the axis of the transverse shaft to trim/tilt and the lower unit pivots about the axis of the drive shaft to steer.

7 Claims, 6 Drawing Sheets

DRIVES FOR PROPULSION OF MARINE VESSELS

FIELD OF THE INVENTION

This invention relates to drives for propulsion of marine vessels. In particular, the invention relates to stern drives.

BACKGROUND TO THE INVENTION

Conventional in-board marine propulsion systems tend to occupy excessive space inside the vessels—typically encroaching on the decks, cockpit, load bay or other useful spaces. The geometry with which different engines can be installed in different vessels to provide optimum use of space varies, but in order to accommodate different engine orientations, different drives are required and the need to provide different drives for matching different engines with different vessels results in additional costs.

The present invention seeks to provide a marine propulsion system that is compact and that can accommodate engines in various space saving configurations.

While there is a need to keep marine propulsion systems compact, it is advantageous for the vessel's handling and for control over trim adjustments if the moment arm for trim adjustments is relatively long and the present invention seeks to provide a compact marine drive with an increased trimming moment.

Most marine propulsion systems extending from the stern of a vessel includes a drive shaft extending downwards and transmitting motive power to a horizontal propeller shaft. The orientation of the drive shaft is typically vertical and the transmission between the drive shaft and propeller shaft typically includes a reversing clutch, comprising counter-rotating bevel gears that are engaged with the drive shaft and that can engage, in turn, with the propeller shaft. This gear set (or alternative arrangement) needs to be housed in a housing of a lower unit of the drive and the housing typically includes a horizontally orientated widened part extending around the propeller shaft, commonly referred to as a "bullet".

The bullet and the vertical part of the casing extending above it, need to be wide enough to house the drive shaft and components for transmitting power to the propeller shaft, as well as the bearings for these components and cooling and lubrication arrangements and the casing needs to be strong enough to bear the loads imposed by these internal components. The net result is that the lower units tent to be bulky, causing drag.

The present invention seeks to provide a marine propulsion system with a compact transmission between its drive shaft and propeller shaft and consequently a more compact and hydrodynamic lower unit of the drive.

SUMMARY OF THE INVENTION

According to one aspect of the present invention there is provided a marine propulsion system comprising:

- an input shaft that is connectable to a source of motive power;
- a transverse shaft that has a transverse orientation relative to the input shaft and that is connected to receive motive power from the input shaft;
- a pivot gear set of bevel gears for transferring motive power from the input shaft to the transverse shaft;
- a drive shaft that extends perpendicular to the transverse shaft;

- a clutch assembly configured to transfer motive power selectively from the transverse shaft to the drive shaft;
- a propeller shaft connected to receive motive power from the drive shaft;
- a gearbox housing supporting the input shaft and transverse shaft for rotation about their respective axes;
- a pivot casing supporting the drive shaft for rotation about its axis, said pivot casing being configured to pivot relative to the gearbox housing, about the axis of the transverse shaft; and
- a lower unit housing supporting the propeller shaft for rotation about the axis of propeller shaft, said lower unit housing being configured to pivot relative to the pivot casing, about the drive axis of the drive shaft.

The gearbox housing can be orientated, in use, with the input shaft axis extending at any desired angular orientation within a range, e.g. horizontally or at an incline.

The marine propulsion system may include an intermediate shaft, extending generally parallel to the input shaft and being connected to receive motive power from the input shaft via a gear set, the intermediate shaft being connected to the transverse shaft via the pivot gear set. The intermediate shaft may be connected to the input shaft via a gear set, such as a set of spur gears or helical gears.

The intermediate shaft axis may extend at a higher elevation than the input shaft axis, in use, with the result that the transverse shaft and thus the pivotal axis about which the pivot casing can pivot, is at an elevated position relative to the vessel.

The clutch assembly may include:

- a pair of bevel gears, comprising a forward gear and a reverse gear, each supported for rotation about the transverse shaft;
- a clutch element, configured to connect the forward gear or the reverse gear to the transverse shaft, to receive motive power from the transverse shaft; and
- a bevel gear disposed on the drive shaft and meshed on opposing sides with the forward gear and the reverse gear.

According to another aspect of the present invention there is provided a marine propulsion system which comprises:

- a drive shaft, configured to receive motive power;
- a propeller shaft, configured to receive a propeller;
- a pinion disposed at a lower end of the drive shaft and rotationally connected to the drive shaft; and
- a gear, rotationally connected to the propeller shaft and meshing with the pinion;

wherein the gear is a face gear, preferably a bevel face gear.

BRIEF DESCRIPTION OF THE DRAWINGS

For a better understanding of the present invention, and to show how the same may be carried into effect, the invention will now be described by way of non-limiting example, with reference to the accompanying drawings in which.

DETAILED DESCRIPTION OF THE DRAWINGS

Figure 1:
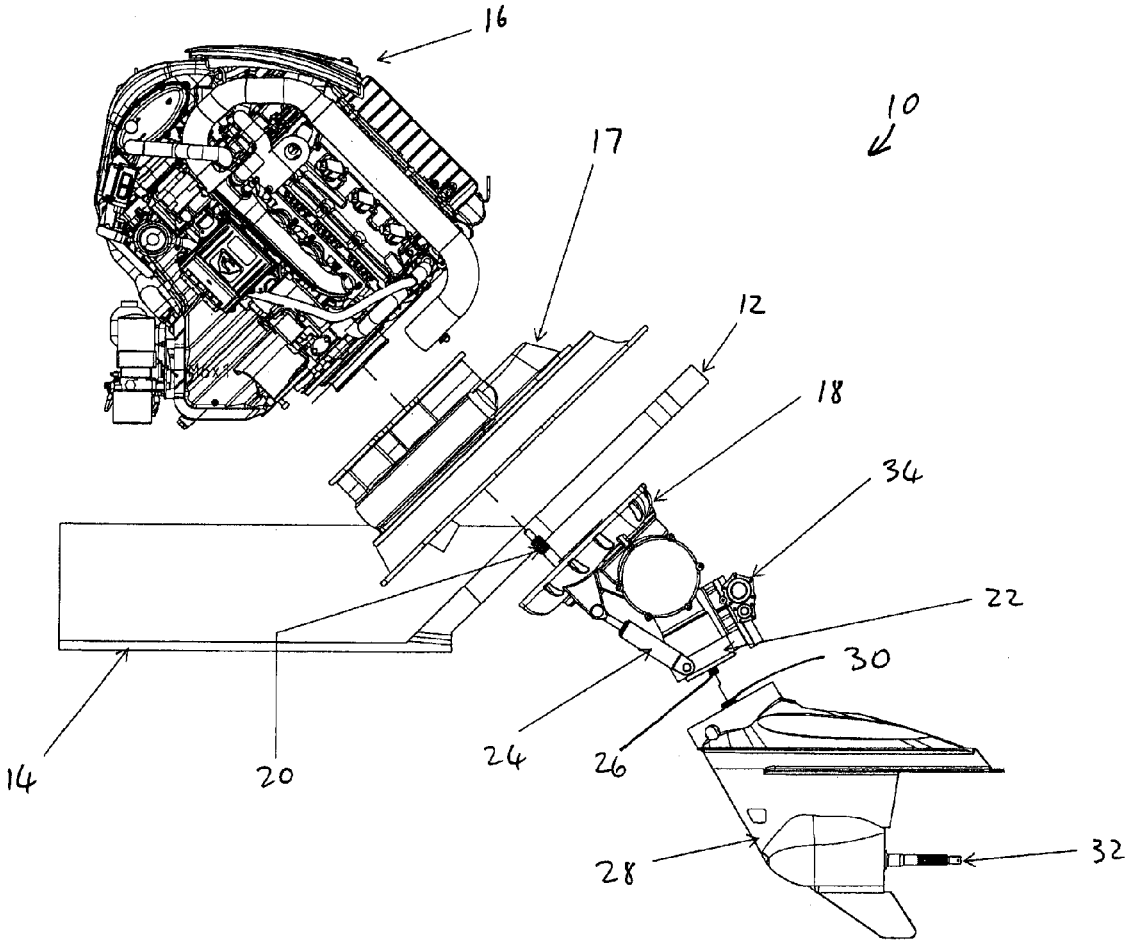
FIG. 1 is and exploded side view of a marine propulsion system according to the present invention.

Referring to the drawings, a marine propulsion system according to the present invention is generally indicated by reference numeral 10 and is referred to by a more common name, as a "stern drive".

The stern drive 10 is installed on a transom 12 of a vessel hull 14 and the transom is angled—e.g. at 45 degrees. The stern drive 10 includes an engine module 16, to serve as a source of motive power for the vessel and the engine module is mounted to the transom 12 by a main power train mount 17. In the illustrated embodiment, the engine module 16 is oriented with the crank shaft of the engine extending at an angle of 45 degrees, but this need not always be the case, as will be described below.

Figure 2:
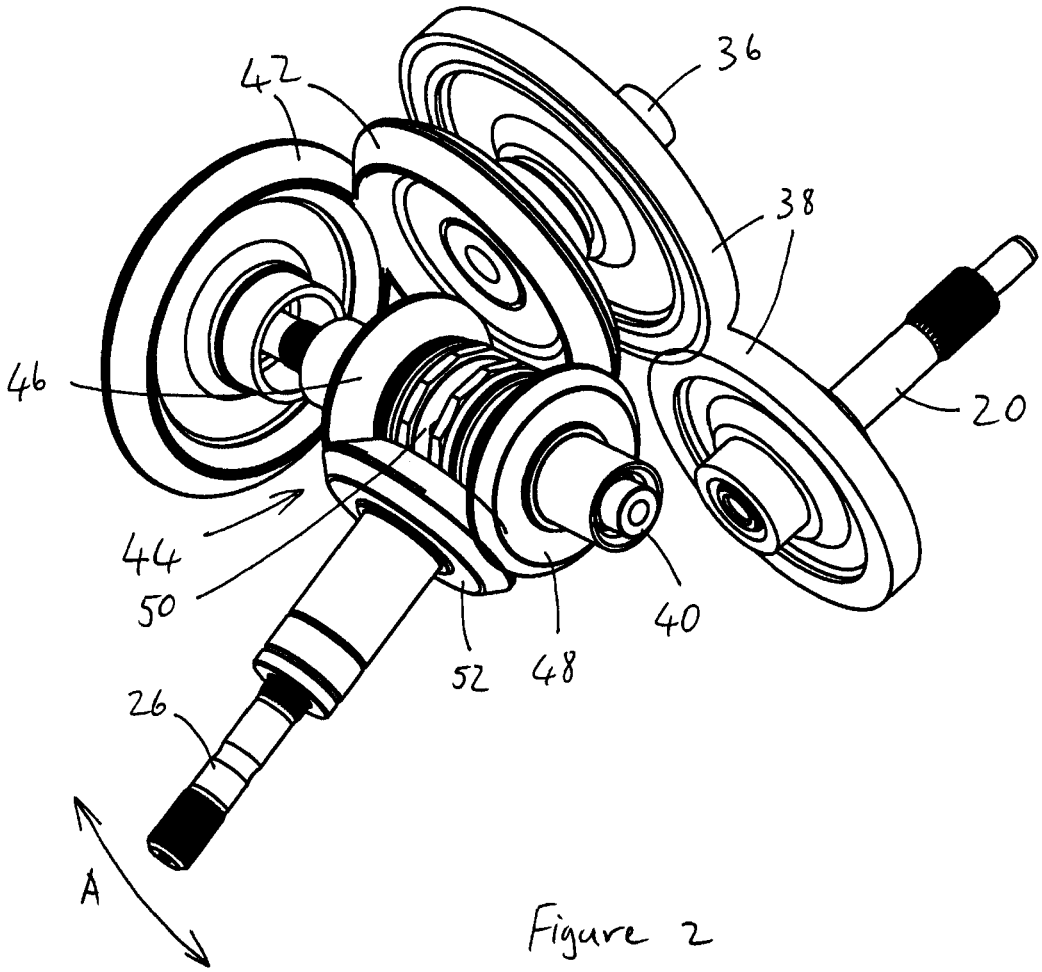
FIG. 2 is an aft, starboard, three-dimensional view of part of the drive train of the propulsion system of FIG. 1.
Figure 3:
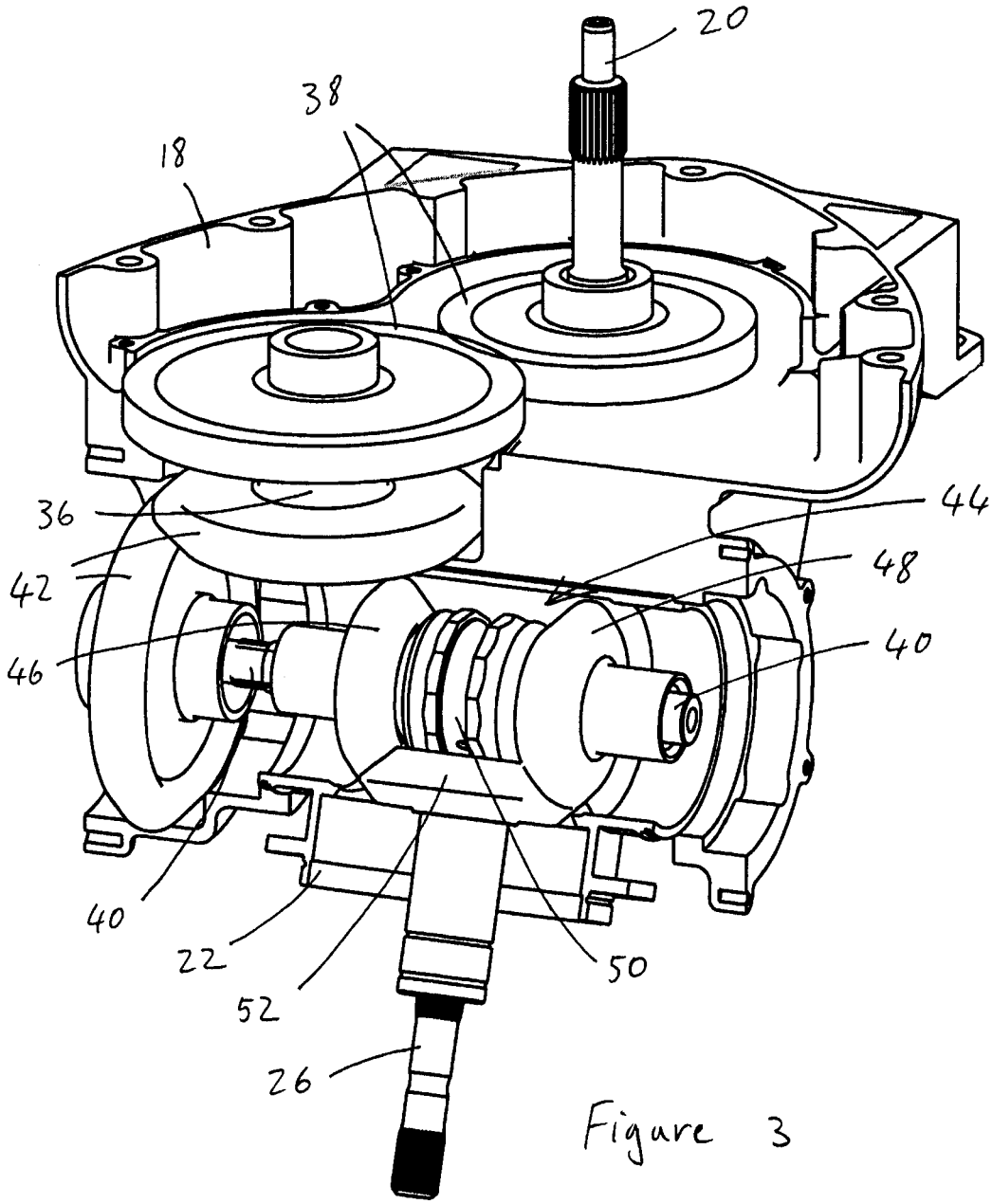
FIG. 3 is an three-dimensional view of part of the propulsion system of FIG. 1, showing the drive train components of FIG. 2.

On the outside (aft) of the transom 12, the stern drive 10 includes a mid section gearbox 18 that is fixedly attached to the transom and has an input shaft 20 extending through an aperture in the transom to receive motive power from the engine module 16. The mid section gearbox 18 is connected to a pivot casing 22, which can pivot relative to the gearbox to trim/tilt the lower part of the stern drive 10 in directions marked "A" in FIG. 2 and the trim/tilt is actuated by a hydraulic cylinder 24. An upper part 26 of a drive shaft protrudes from the bottom of the pivot casing 22.

Figure 5:
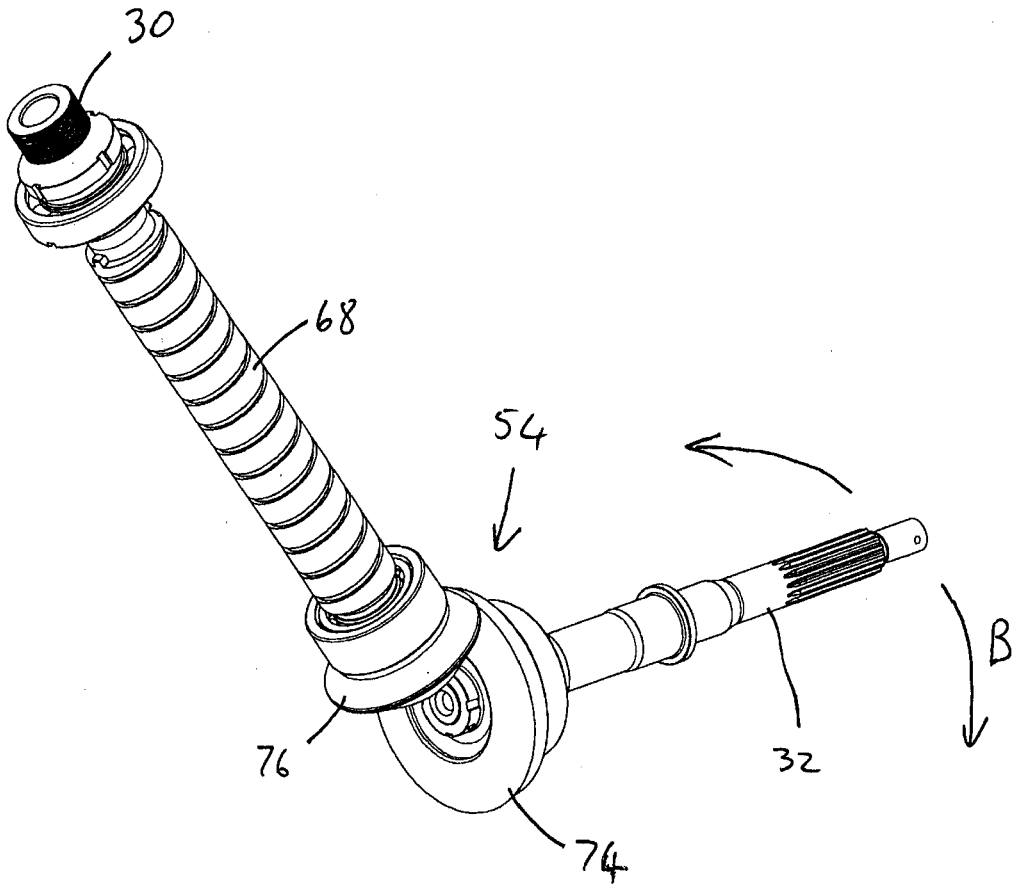
FIG. 5 is a fore, port, three-dimensional view of a lower part of the drive train of the propulsion system of FIG. 1.
Figure 7:
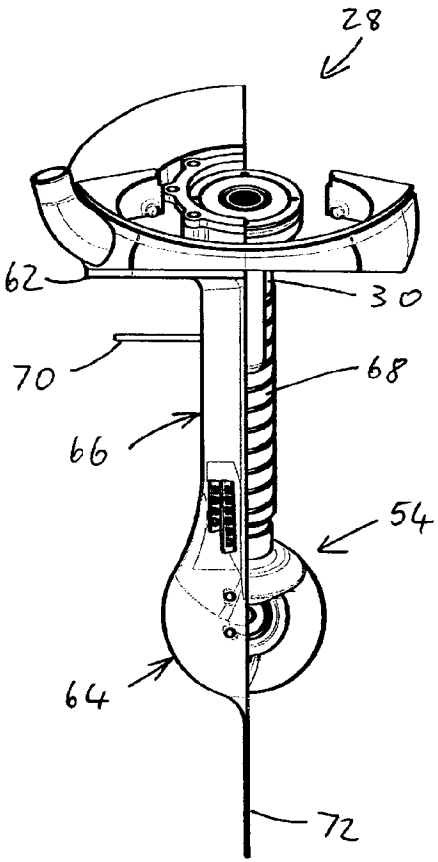
FIG. 7 is a part sectional front view of the lower unit of the propulsion system of FIG. 6.
Figure 6:
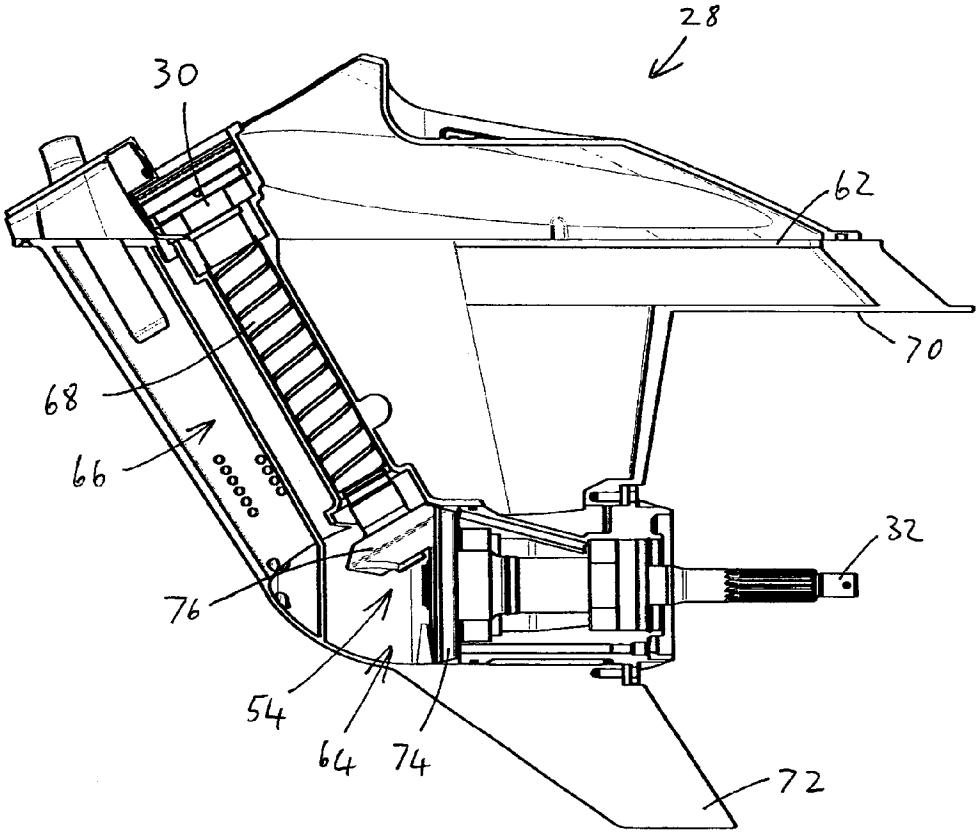
FIG. 6 is a part-sectional side elevation of a lower unit of the propulsion system of FIG. 4, showing the lower part of the drive train of FIG. 5.

The stern drive 10 includes a lower unit housing 28 that is attached to the lower end of the pivot casing 22 and a lower part 30 of the drive shaft protrudes from the lower unit, to be connected for receiving motive power from the upper part 26. A propeller shaft 32 protrudes aft from the lower unit 28 and can carry a propeller for propulsion of the vessel. The lower unit 28 can pivot relative to the pivot casing 22 in steering directions marked "B" in FIG. 5, about a steering axis that is coaxial with the drive shaft 26,30 and the pivotal movement is actuated by a steering system 34.

A drive train of the stern drive 10 includes an intermediate shaft 36 that extends parallel to the input shaft 20 on the port side of the input shaft and with its axis at a higher elevation than that of the input shaft. The intermediate shaft 36 receives motive power from the input shaft 20 via a drop gear set 38 of spur gears or helical gears. The drop gear set 38 can easily be replaced with a different gear set with a different gear ratio, e.g. if a petrol engine module 16 is to be replaced with a (lower revving) diesel engine. The drive train further includes a transverse shaft 40 that extends horizontally—aft of the input shaft 20 and intermediate shaft 36 and with its axis above the axis of the input shaft. The transverse shaft 40 receives motive power from the intermediate shaft 36 via a pivot gear set 42 of bevel gears. The input shaft 20, drop gear set 38, intermediate shaft 36, pivot gear set 42 and transverse shaft 40 are all supported in the casing of the mid section gearbox 18 and while each of the components is configured to rotate about its own axis, none of these components are configured to move relative to the pivot casing or any other parts that are fixedly attached to the vessel hull 14.

The feature of the stern drive 10, of the axes of the intermediate shaft 36 and the transverse shaft 40 extending higher than the axis of the input shaft 20, means that the drive shaft 26,30, pivot casing 22 and lower unit 28 (i.e. the whole part of the stern drive 10 that pivots in trim/tilt directions A) extends over a longer distance to the propeller, than if these parts extended from the height of the input shaft and this increases the moment arm between the propeller and the vessel hull 14, which improves trim control and handling of the vessel. Despite this improvement, the stern drive 10 is extremely compact.

In another embodiment of a stern drive according to the present invention, the intermediate shaft and drop gear set may be omitted and the input shaft may be connected directly to the transverse shaft by a pivot gear set. However, the geometry of the illustrated embodiment is preferred over such an embodiment, because in the illustrated embodiment, the input shaft 20 and drive shaft 26,30 are aligned on a central vertical plane of the stern drive 10 and the sizes (and thus circumferential velocities) of the components are relatively small—which would not be the case if the intermediate shaft and drop gear set were omitted.

The pivot casing 22 supports the upper part 26 of the drive shaft, as well as a clutch assembly 44 that is configured to transfer motive power from the transverse shaft to the drive shaft. The clutch assembly 44 includes a pair of bevel gears that are supported to rotate about the transverse shaft 40 and the pair of bevel gears includes a forward gear 46 and a reverse gear 48. A clutch element 50 is also supported on the transverse shaft 40, between the pair of bevel gears 46,48 and is configured to slide selectively, axially along the transverse shaft, to connect the forward gear or the reverse gear to the transverse shaft, to receive motive power from the transverse shaft. The forward gear 46 and the reverse gear 48 are meshed on opposing sides with a driven bevel gear 52 on an upper end of the drive shaft 26, so that the drive shaft receives motive power from the clutch assembly 44 either via the forward gear or reverse gear, depending on which one is engaged by the clutch element.

The pivotal movement of the pivot casing 22 relative to the mid section gearbox 18 takes place about the axis of the transverse shaft 40 in directions A. During this pivotal movement (which trims or tilts the pivot casing 22 and lower unit 28 relative to the vessel) the pair of bevel gears 46,48 and the clutch element 50 remain in position, the drive shaft 26 and driven bevel 52 pivot with the pivot casing 22, the bevel gears 46,38,52 remain meshed and all of these components can continue to transfer motive power.

Inside the lower unit 28, the lower part 30 of the drive shaft receives motive power via a splined, coaxial connection from the upper part 26 of the drive shaft and the lower part of the drive shaft is supported for rotation about its axis, inside the lower unit 28. The drive shaft 30 is connected to transfer motive power to the horizontal propeller shaft 32 via a lower unit gear set 54.

Drive shaft 26,30 has an angled or inclined orientation and as mentioned above, the lower unit 28 is configured to pivot relative to the pivot casing 22 in directions B and thus relative to the rest of the stern drive 10 and to the vessel, about the axis of the drive shaft. This pivotal movement changes the orientation of the propeller shaft 32 to port and starboard and thus steers the vessel, without disrupting the position, operation or mechanical connection between the drive shaft 30, lower unit gear set 54 or propeller shaft.

Figure 4:
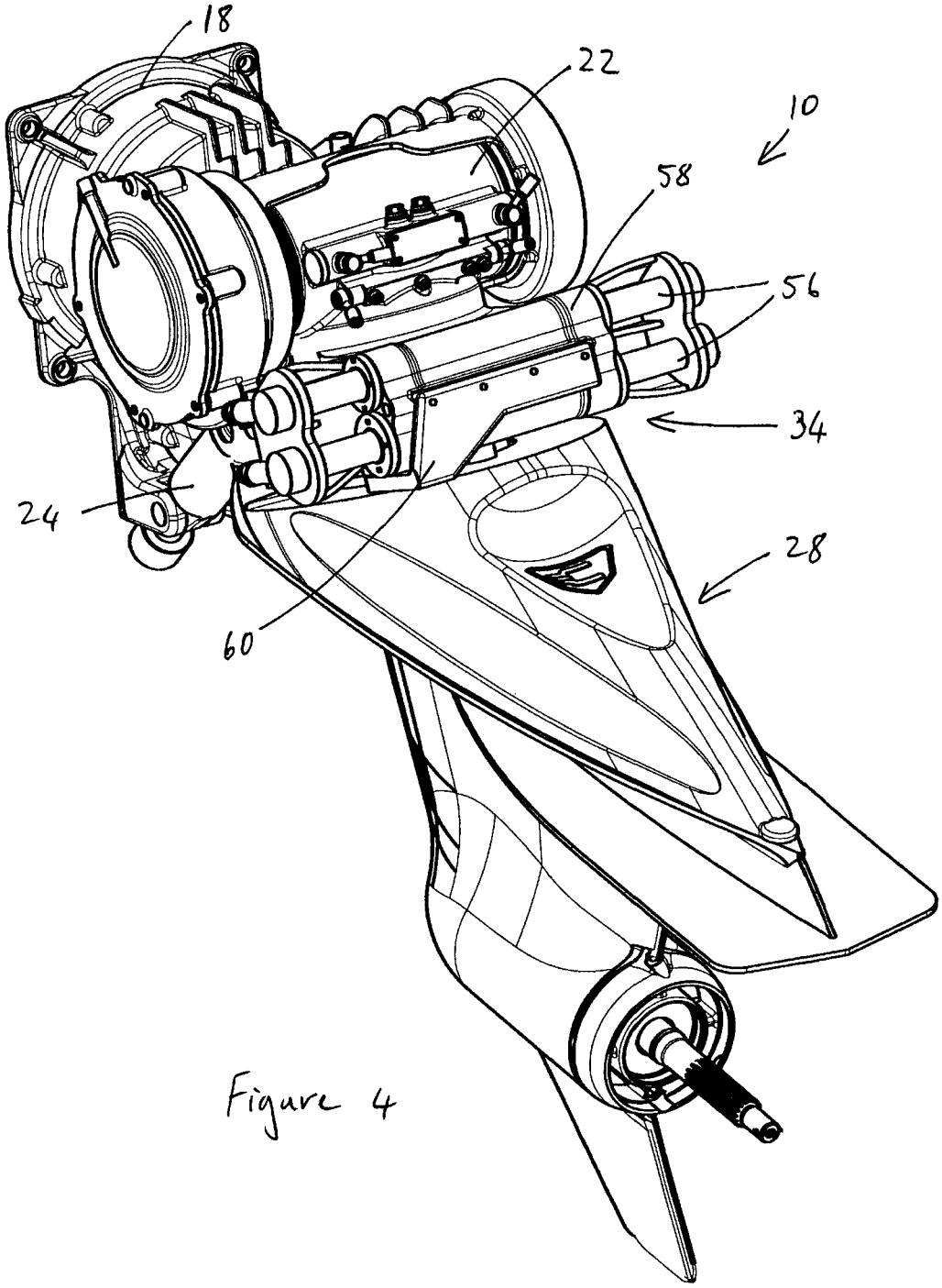
FIG. 4 is an aft, port, three dimensional view of part of the propulsion system of FIG. 1, although the propulsion system shown in FIG. 4 differs slightly from that shown in FIG. 1, but not in ways material to the present invention.

An example of a steering system 34 is shown in some detail in FIG. 4 and it includes a master-and-slave hydraulic piston arrangement, with the ends of the piston rods 56 connected to the pivot casing 22 and the pistons connected to a reciprocal body 58 that can travel in port-starboard directions and that is connected to the lower unit 28 via a hinge mechanism 60.

As mentioned above, the engine module 16 and the transom 12 have angled orientations in the illustrated embodiment, but the stern drive 10 can also be used on vessels with transoms at different orientations (e.g. near upright transoms) and/or for different engine orientations (e.g. in a "run-flat" configuration with the engine's crankshaft in a horizontal orientation). This can be achieved by simply fitting the mid section gearbox 18 to the vessel with the input shaft 20 aligned with a suitable power take-off of the engine module, and adjusting the orientation of the pivot casing 22 and lower unit 28 by operating the trim/tilt cylinder 24. If required, the length and/or stroke of the trim/tilt cylinder 24 can be adjusted to optimise the trim/tilt action of the stern drive for a particular orientation of the drive, but generally, the drive 10 can be used for various vessel and engine configurations, without significant modification.

The lower unit 28 is relatively wide at its upper end—where it has a cylindrical shape, matched to the cylindrical lower end of the pivot casing 22. However, at a height that typically coincides with the water line during use, the lower unit 28 forms a horizontal spray plate 62 and the profile (viewed from the bow or stern) of the lower unit is significantly narrower below the spray plate. A part of the lower unit 28 that extends generally coaxially around the propeller shaft 32 is widened and has a streamlined appearance, to form a formation known in the trade as a "bullet" 64, which houses the gear set 54 in part, as well as the bearings for the propeller shaft 32 and an exhaust passage. Between the spray plate 62 and the bullet 64, the lower unit forms a shank 66 that is narrower than the bullet 64 and which houses the lower part 30 of the drive shaft, an Archimedean lubrication screw 68, a lower bearing for the drive shaft and part of the gear set 54. The lower unit 28 also has a thin horizontal cavitation plate 70 protruding from the shank 66 below the spray plate 62 and a skeg 72 extending below the bullet 64.

The diameter of bullet 64 is typically about the same as the hub diameter of propeller fitted on the propeller shaft 32 and accordingly, the cylindrical part of the bullet has little impact on drag. Likewise the thin profiles of the cavitation plate 70 and skeg 72 keep their impacts on drag to a minimum. However, the profile of the shank 66 and in particular a lower end of the shank, where it widens to join up to the bullet 64, is directly before the swept area of the propeller and has a significant impact on drag.

The lower unit gear set 54 includes a face gear 74, preferably a bevel face gear connected to the fore end of the propeller shaft 32 and a matching pinion 76 at the lower end of the drive shaft 30. The use of the face gear 74 instead of a conventional bevel gear, reduces the height of the pinion 76 in relation to the propeller shaft 32 and the bullet 64, so that the pinion is entirely, or almost entirely housed within the bullet, without protruding significantly into the lower end of the shank 66.

The invention claimed is:

1. A marine propulsion system comprising:

an input shaft that is connectable to a source of motive power;

a transverse shaft that has a transverse orientation relative to the input shaft and that is connected to receive motive power from the input shaft;

a pivot gear set of bevel gears for transferring motive power from the input shaft to the transverse shaft;

a drive shaft that extends perpendicular to the transverse shaft;

a clutch assembly configured to transfer motive power selectively from the transverse shaft to the drive shaft;

a propeller shaft connected to receive motive power from the drive shaft;

a gearbox housing supporting the input shaft and transverse shaft for rotation about their respective axes;

a pivot casing supporting the drive shaft for rotation about its axis, said pivot casing being configured to pivot relative to the gearbox housing, about the axis of the transverse shaft; and a lower unit housing supporting the propeller shaft for rotation about the axis of propeller shaft, said lower unit housing being configured to pivot relative to the pivot casing, about the drive axis of the drive shaft.

2. A marine propulsion system as claimed in claim 1, wherein the gearbox housing can be orientated with the input shaft axis extending at any desired angular orientation within a range.

3. A marine propulsion system as claimed in claim 1, wherein said marine propulsion system includes an intermediate shaft, extending generally parallel to the input shaft and connected to receive motive power from the input shaft via a gear set, said intermediate shaft being connected to the transverse shaft via the pivot gear set.

4. A marine propulsion system as claimed in claim 3, wherein the intermediate shaft axis extends at a higher elevation than the input shaft axis.

5. A marine propulsion system as claimed in claim 1, wherein the clutch assembly includes:

a pair of bevel gears, comprising a forward gear and a reverse gear, each supported for rotation about the transverse shaft;

a clutch element, configured to connect the forward gear or the reverse gear to the transverse shaft, to receive motive power from the transverse shaft; and a bevel gear disposed on the drive shaft and meshed on opposing sides with the forward gear and the reverse gear.

6. A marine propulsion system as claimed in claim 1 wherein:

the drive shaft is configured to receive motive power;

the propeller shaft is configured to receive a propeller, and the marine propulsion system further comprises:

a pinion disposed at a lower end of the drive shaft and rotationally connected to the drive shaft; and a face gear, rotationally connected to the propeller shaft and meshing with the pinion.

7. A marine propulsion system as claimed in claim 6, wherein said face gear is a bevel face gear.

* * * * *